United States Patent [19]

Green

[11] 3,937,191

[45] Feb. 10, 1976

[54] ROCKET LAUNCHER INCLUDING REMOTELY RELEASABLE PIN LATCH

[75] Inventor: Charles J. Green, Vashon Island, Wash.

[73] Assignee: Estes Industries Inc., Penrose, Colo.

[22] Filed: Mar. 25, 1974

[21] Appl. No.: 454,087

Related U.S. Application Data

[62] Division of Ser. No. 223,452, Feb. 4, 1972, Pat. No. 3,820,275.

[52] U.S. Cl. ..... 12.4/11 R; 124/34; 124/41 R

[51] Int. Cl.[2] ..... F41F 3/04

[58] Field of Search ..... 124/11, 41, 40; 89/1.806; 102/34.2; 46/74 B, 74 C

[56] References Cited

UNITED STATES PATENTS

| | | | |
|---|---|---|---|
| 2,927,398 | 3/1960 | Kaye et al. | 46/74 C |
| 3,010,444 | 11/1961 | Finnigan | 46/74 C X |
| 3,067,730 | 12/1962 | Merz | 124/40 X |
| 3,121,292 | 2/1964 | Butler et al. | 46/74 B |

FOREIGN PATENTS OR APPLICATIONS

| | | | |
|---|---|---|---|
| 1,330,882 | 5/1963 | France | 46/74 B |

*Primary Examiner*—F. Barry Shay
*Attorney, Agent, or Firm*—Kenway & Jenney

[57] ABSTRACT

Toy rocket launcher adapted for refueling and for remotely triggering the launch of a rocket positioned thereon. The launcher comprises a body having a recessed platform for receiving the end of the nozzle of a toy rocket; a channel for refueling, communicating between the exterior of the body and the surface of the platform, and; a resilient, hemispherical, sealing member, positioned on the platform, which has an opening communicating with the channel and is adapted to sealingly engage the nozzle of the rocket when in position. A remotely releasable latch is controlled by a removable pin which, when manually extracted from a point remote from the launcher, releases the latch and triggers launching.

1 Claim, 5 Drawing Figures

ROCKET LAUNCHER INCLUDING REMOTELY RELEASABLE PIN LATCH

This is a division of application Ser. No. 223,452 Filed Feb. 4, 1972, now U.S. Pat. No. 3,820,275.

BACKGROUND OF THE INVENTION

The present invention relates to a toy rocket, a rocket motor therefor and a launch mechanism, and more particularly to a staged toy rocket, a rocket motor fueled by a self-pressurizing liquid, and a combined launcher and fueling apparatus for the rocket motor.

Toy rockets propelled by a variety of fuels are well-known in the art. Many such toy rockets are capable of staging operations for example to release parachutes for descent braking. Most such toy rockets of the prior art, however, are relatively complex and expensive. In addition, many such rockets utilize fuels with which special precautions must be taken to ensure the safety of a person operating the rocket.

It is an object of the present invention to provide a rocket launcher and fueling mechanism for use with the rocket motor of the present invention. It is an object of the invention to provide a launcher which has a latch mechanism for retaining the rocket motor prior to launch. It is a further object of the invention to provide a gas and liquid seal between the launcher and the rocket motor. It is a related object to provide a seal between the rocket motor and the launcher which dispenses with accurate seating of the rocket motor in the launcher. It is a further object of the latch mechanism to ensure fluid tight seating of the rocket motor on the seal.

It is a further object of the rocket motor of the present invention to provide a release mechanism which engages at least a portion of the rocket body when the rocket motor is filled with propellant and to release the rocket body when the propellant is exhausted. It is a further object of the invention to provide a release mechanism which can be easily incorporated into a rocket motor and which can be fabricated inexpensively. It is a further object of the release mechanism to provide a time delay for release of the rocket body after the propellant in the rocket motor has been exhausted.

SUMMARY OF THE INVENTION:

The above objects, and others, will be apparent to those of ordinary skill in the art from the drawings and description of the preferred embodiment found below.

The invention provides a rocket launcher comprising a body having a platform on the top thereof for receiving the end of the rocket nozzle, the body having a channel communicating between the exterior of the body and the surface of the platform, a resilient seal member having an opening therethrough, the seal member positioned on the platform, the opening aligned with the channel in the body, the opening also adapted to communicate with a rocket nozzle positioned on the platform, releasable latch means movably mounted in the body for retentively engaging a rocket nozzle in sealing engagement with the seal member, the latch means movable between a retention position and a release position.

BRIEF DESCRIPTION OF THE DRAWINGS:

A better understanding of the present invention can be derived by reading the ensuing specification in conjunction with the accompanying drawings wherein.

Figure 1:
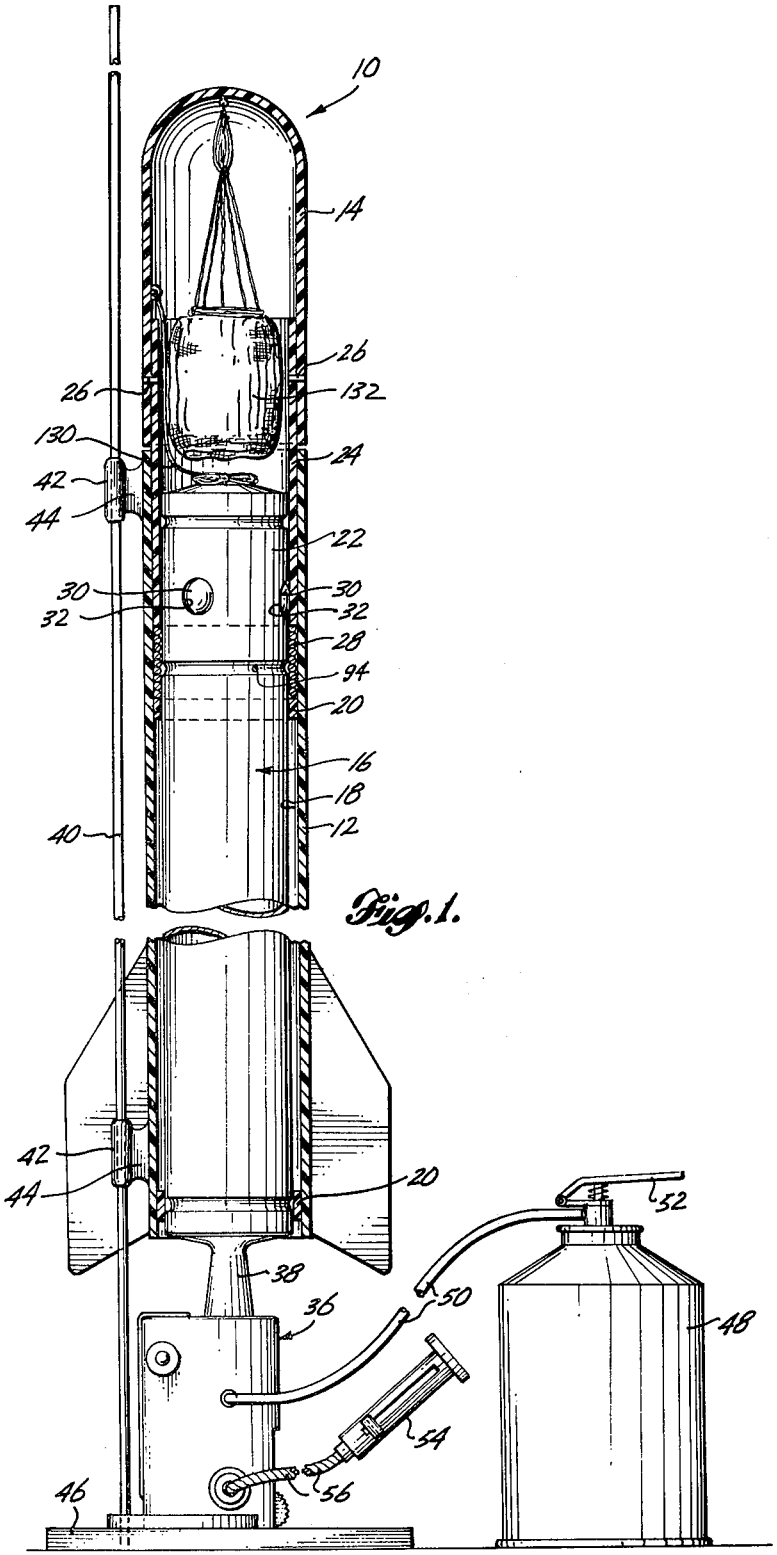
FIG. 1 is an elevation view in partial cross section of the rocket, rocket motor and launcher of the present invention in position for launch.

DESCRIPTION OF PREFERRED EMBODIMENTS:

Referring to FIG. 1, the rocket, rocket motor and launcher of the present invention are shown in partial cross section poised for launch. The rocket, generally designated 10, includes a forward first stage portion 12 and a rearward second stage portion 14. A rocket motor 16 is positioned within the motor receptacle 18 of the first stage 12.

The rocket 10 rests on a launcher mechanism 36, described in detail later, by engaging the nozzle 38 of rocket motor 16. The rocket 10 is vertically supported by launch wire 40, which slidably engages tubes 42 attached by brackets 44 by the outer walls of first stage 12. The launch wire 40 is supported in a base 46. The launcher 36 also rests upon base 46. A launcher release handle 54 is connected via bowden cable 56 to the launcher 36 for remote launch of the rocket 10.

Propellant is supplied to the rocket motor 16 from a propellant source 48 via tube 50. A fueling channel is provided in the launcher 36 which communicates with the nozzle 38 and thus with a propellant cavity in rocket motor 16. A preferred propellant for use with the rocket motor of the present invention is a volatile, self-pressurizing halogenated hydrocarbon which is a liquid at atmospheric temperatures and superatmospheric pressures. A suitable propellant is "Freon -12" sold by E. I. du Pont de Nemours and Company of Wilmington, Delaware. The propellant is supplied to the rocket motor 16 by depressing the valve lever 52 on the propellant source 48.

Figure 2:
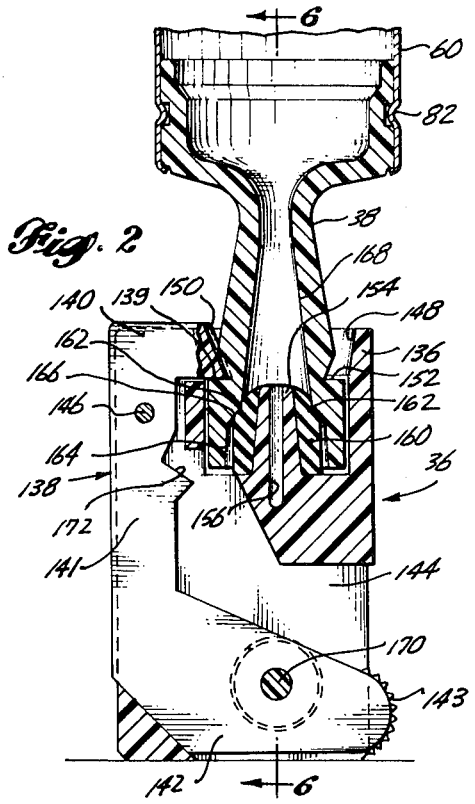
FIG. 2 is a cross-sectional view of the rocket launcher with rocket nozzle in place.
Figure 3:
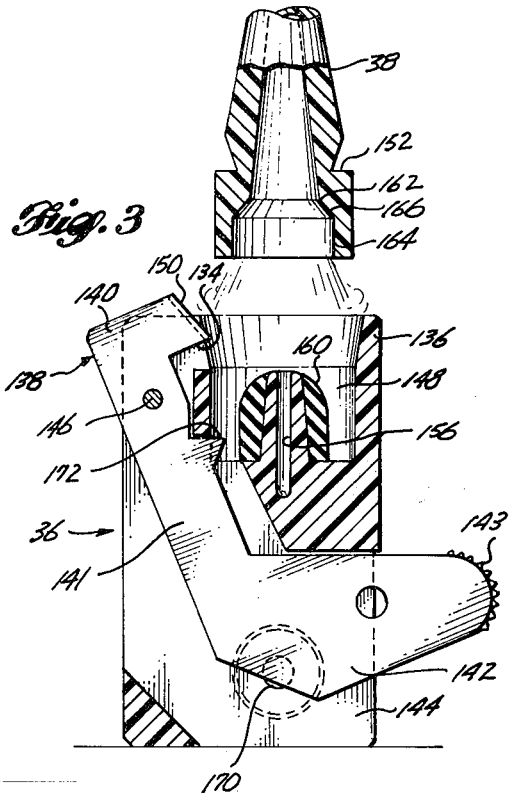
FIG. 3 is a cross-sectional view of the rocket launcher in the release position.
Figure 4:
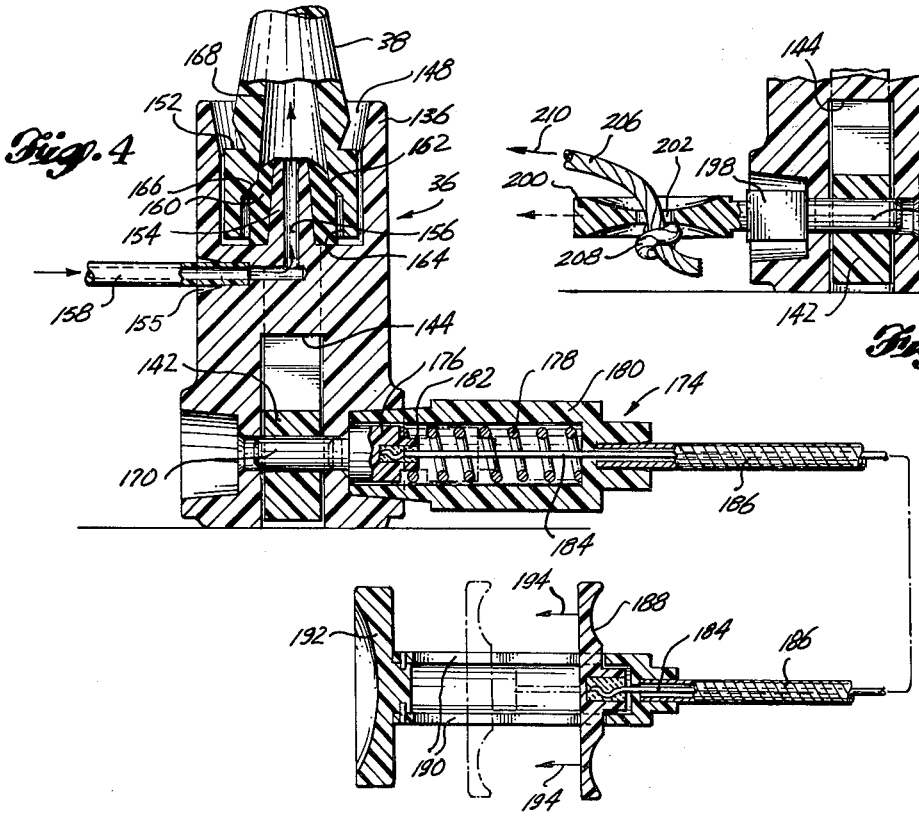
FIG. 4 is a cross-sectional view of the rocket launcher taken along a line similar to 4—4 of FIG. 2.

Referring now to FIGS. 2, 3 and 4, detailed cross-sectional views of the launch mechanism 36 are illustrated. FIGS. 2 and 4 illustrate the launch assembly in its retention position and FIG. 3 illustrates the assembly in its release position. The launcher 36 includes a body portion 136 which can be molded in a single piece from a suitable thermoplastic or thermosetting polymer. A latch member 138 is positioned within a space 144 provided therefor in the body 136. the latch member 138 is mounted for pivotal movement within the body 136 by pivot pin 146. The upper portion of the body 136 contains a recess 148 opening to the outside of the body 136. Recess 148 is sized to receive a rocket nozzle 38, of for example the rocket motor of the present invention. The bottom surface of the recess 148 serves as a launch platform. When the nozzle 38 is in place, the upper portion 139 of the latch member 138 engages a shoulder 152 provided on the exterior of the nozzle 38.

The upper portion 139 of the latch member 138 is connected to outwardly extending portion 140. Portion 140 is in turn connected to downwardly extending portion 141. Pin 146 pivotally mounts the portion 141. Portion 142 of the latch member 138, connected to portion 141, extends inwardly under recess 148 and terminates in serrated end 143. The coaction of the various portions 139 through 143 of the latch member 138 provides positive seating of nozzle 38 on the resilient hemispherical seal member 160. An inward force applied by an operator's finger to the serrated portion 143 will be multiplied by latch 138 so that the nozzle 38 is forced downwardly onto seal 160.

A male member 154 extends upwardly from the bottom of recess 148. A channel 156 runs through the center of the male member 154 and communicates with a recess 155 in the side of the body 136. A fuel supply tube 158 is inserted in an interference fit into the recess 155. The rubber seal member 160 of annular cross section is fitted over the male member 154 in the recess 148. The top portion of the seal member 160 has a substantially spherical curvature which mates with the ring-like seat 162 in the opening of the nozzle 38. It will be noted that the nozzle has a wide port 164 of circular cross section which mates with an inwardly tapering section 166. Section 166 tapers inwardly to meet with the slightly inwardly tapering section of the nozzle port 168. The juncture of section 166 and 168 forms the ring-like seat 162. Since the top portion of the seal member 160 is spherically shaped and the ringedge seat 162 is circular, the nozzle member will readily seat on the seal member 160 without precise alignment.

A latch pin 170 is inserted through an opening in the body 136 of the launcher 36 and mates with an opening in the bottom portion 142 of latch member 138. Latch pin 170 serves to retain the latch member 138 in its locked position, holding the nozzle 38 against seal member 160 during fueling and prior to launch. When it is desired to launch the rocket, the latch pin 170 is retracted from the opening in latch member 138. The upward thrust from nozzle 38 forces the latch member 138 to its open position as shown in FIG. 3. It will be noted that a small shoulder 172 forming a part of latch portion 141 protrudes into the recess 148 when the latch member 138 is in the open position. If the nozzle 38 becomes too firmly seated on the seal 160, the shoulder 172 will bear against the bottom edge of nozzle 38 forcing it upward and allowing additional thrust to develop from the nozzle 38.

Also shown in FIG. 4 is a remote latch pin release mechanism generally designated 174. Latch pin 170 has an annular shoulder 176 against which a coil spring 178 inside housing 180 bears. The rear portion 182 of latch pin 170 is connected to the wire 184 of a bowden cable 186. The wire 184 at its other end is connected to trigger member 188, which is mounted for sliding movement in channels 190 in the thumbpiece 192. As the trigger member 188 is pulled in the direction of arrow 194, the bowden wire 184 is also pulled in the same direction. Thus latch pin 170 moves out of registry with the opening in latch member 138 to release the latch member 138.

Figure 5:
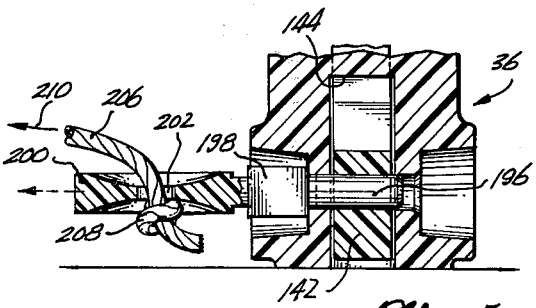
FIG. 5 is an alternative embodiment of the release pin for the launcher.

An alternate latch pin release mechanism is shown in FIG. 5. In this figure the latch pin 196 has an annular shoulder portion 198 which is in turn connected to an extended rear portion 200. Rear portion 200 contains an aperture 202 into which lanyard 206 is inserted. A knot 208 is tied in the lanyard to prevent separation from the aperture 202. As the lanyard is manually pulled backwardly in the direction of arrow 210, latch pin 196 disengages from the opening in latch member 138 to release the rocket nozzle.

The present invention has been described in relation to a preferred embodiment and alternates thereto. Those of ordinary skill in the art will be able to effect various alterations, substitutions of equivalents and other changes without departing from the original concept of the invention. It is intended that the present invention be limited only by the definition contained in the appended claims.

What is claimed is:

1. A toy rocket launcher adapted for refueling a rocket positioned thereon and for remotely triggering the launch of a rocket, said launcher comprising:

a body having a recessed platform on the top thereof and a male member in the recess of said recessed platform for receiving the end of the nozzle of a rocket in said recess and around said male member, said body having a channel communicating between the exterior of said body and the surface of said male member:

a resilient, hemispherical seal member positioned on said male member and having an opening communicating with said channel in said body, said seal member being adapted to sealingly engage the nozzle of a rocket;

means for retentively engaging a rocket nozzle when a nozzle is in sealing engagement with said seal member and for releasing a nozzle in response to movement thereof away from said seal member, said means including a remotely releasable latch pivotally mounted in said body;

said latch and said body having holes positioned to be in alignment when said latch is in retentive engagement with a nozzle;

a pin adapted for engaging the aligned holes in said latch and said body, and;

means for extracting said pin from a point remote from said launcher, to release said latch and enable a rocket seated on said launcher to be launched.

* * * * *